United States Patent [19]

Buneta

[11] 4,273,330

[45] Jun. 16, 1981

[54] BOWLER'S FINGER SUPPORT

[76] Inventor: Paul Buneta, 7101 S. Grand Ave., St. Louis, Mo. 63111

[21] Appl. No.: 24,303

[22] Filed: Mar. 27, 1979

[51] Int. Cl.[3] ..... A63B 69/00

[52] U.S. Cl. ..... 273/54 B; 294/25

[58] Field of Search ..... 273/54 B; 294/25; 2/21; 128/87 A

[56] References Cited

U.S. PATENT DOCUMENTS

| | | | |
|---|---|---|---|
| 1,465,223 | 8/1923 | Kobbe | 273/54 B UX |
| 3,091,455 | 5/1963 | De Mire | 273/54 B |
| 3,214,167 | 10/1965 | Pell | 273/54 B |
| 3,248,112 | 4/1966 | Metzger | 273/54 B |
| 3,606,319 | 9/1971 | Borden | 273/54 B |
| 3,772,706 | 11/1973 | Brigidi | 273/54 B X |
| 4,194,736 | 3/1980 | Loafman | 273/54 B |

*Primary Examiner*—Anton O. Oechsle
*Attorney, Agent, or Firm*—Paul M. Denk

[57] ABSTRACT

This invention pertains to a finger support to be worn upon the little finger of a bowler and useful for causing a slight displacement of the ball from the finger and that portion of the palm adjacent thereto, thereby effecting an urging of the ball and its accompanying weight towards the center of the palm and also towards the index finger of the bowler's hand in order to allow for his greater control over the ball delivery during participation in the sport of bowling. The support includes a base member that extends longitudinally of the little finger, having a band surrounding the little finger at this location, while the lower portion of the base member is widened to furnish that amount of ball elevation from the hand at this position to attain the foregoing attributes from the invention.

8 Claims, 10 Drawing Figures

BOWLER'S FINGER SUPPORT

CROSS-REFERENCE TO RELATED APPLICATION

The subject matter of this application is related to and incorporates by reference the contents of the disclosure document filed in the U.S. Patent and Trademark Office on June 1, 1978, under Disclosure Document No. 071,702.

BACKGROUND OF THE INVENTION

This invention relates generally to an accessory for use during bowling, and more particularly pertains to a support to be worn upon the little finger of a bowler's hand, and effectively cause a shift of the bowling ball weight towards the controlling index finger and central portion of the delivery hand palm so as to allow the bowler to maintain greater control over release of the ball while bowling.

Numerous styles of supports and other type of reinforcing means are customarily utilized by the athletes during participation in various sports of choice. For example, during the game of golf, there is the glove that is worn by the golfer during usage. Furthermore, in bowling, one frequently sees the use of a glove that extends high upon the wrist of the bowler to strengthen and to reinforce the wrist of the bowler in order to enhance his delivery. The current invention, though, has a more delicate utility than just to simply add reinforcing strength to the bowler's hand, and, essentially is designed to provide for a shift in the center of gravity of the ball's weight towards that portion of the bowler's hand that customarily controls the ball delivery and desired amount of incident spin to the ball through bowling.

It is, therefore, the principal object of this invention to provide structural means for shifting the weight of the bowling ball towards that index finger that generally induces the desired amount of ball spin during a delivery.

A further object of this invention is to provide means for disposition at one location upon the bowler's hand for improving his or her performance from that controlling segment of the same hand.

A further object of this invention is to provide a support that effectively displaces the ball from one side and adjacent palm portion of the bowler's hand for shifting of the ball's weight laterally to the other side of the hand.

A further object of this invention is to provide a means for reinforcing the supporting attributes of that region of the bowler's hand proximate the location of its little finger.

Another object of this invention is to provide a support for the bowler's hand that effectively allows the applying of more pressure onto the ball during its release during bowling.

A further object of this invention is to provide a bowler's finger support that furnishes for a better grip upon the ball, and a consequent smooth and more straight release of the ball and its eventual development of the necessary hook during ball delivery.

These and other objects will become more apparent to those skilled in the art upon reviewing the summary of this invention, and upon undertaking a study of its preferred embodiment in view of the drawing.

SUMMARY OF THE INVENTION

This invention contemplates the formation of a support to be worn upon the little finger of a bowler. This support is designed from generally a tubular type flexible material, such as a polymer or the like, having its upper portion design cut into the formation of a cradle and integral band, for resting against the little finger and securing of the support thereto, as by means of the band, while the lower portion of the support is of tubular shape, and having a spacer means inserted therein for the purpose of widening the support at this location into greater contiguity against a larger portion of the hand palm proximate said little finger. In addition, this lower portion of the support may also have an aperture, slot, or some concavity formed at this location, so as to provide a means for seating of the ball with respect to this support and its general urging towards the center of the palm of the bowler's hand, and more preferrably a transferring of the ball weight more towards the direction of the controlling index finger that regulates the amount of spin transferred to the ball during its release. A band means may secure through the widened lower portion of the support, and may fasten around the palm of the bowler's hand so as to insure the proper emplacement of this support and efficiency in its usage during ball conveyance and delivery by the bowler.

Brief Description of the Drawings

In the drawings, FIG. 1 provides a view of a bowling ball and the locating of the bowler's hand thereon, and further showing the band means of the support of this invention.

DESCRIPTION OF THE PREFERRED EMBODIMENT

Figure 1:
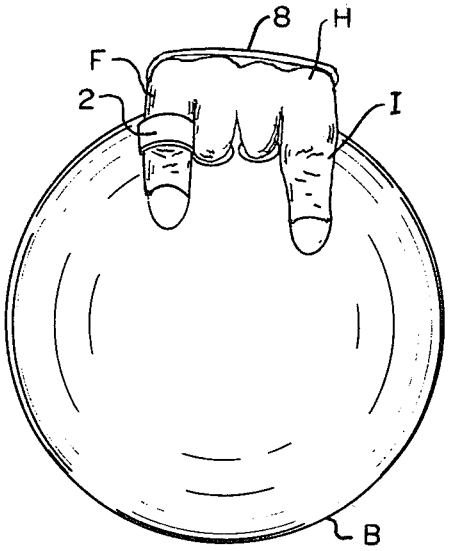
Figure 2:
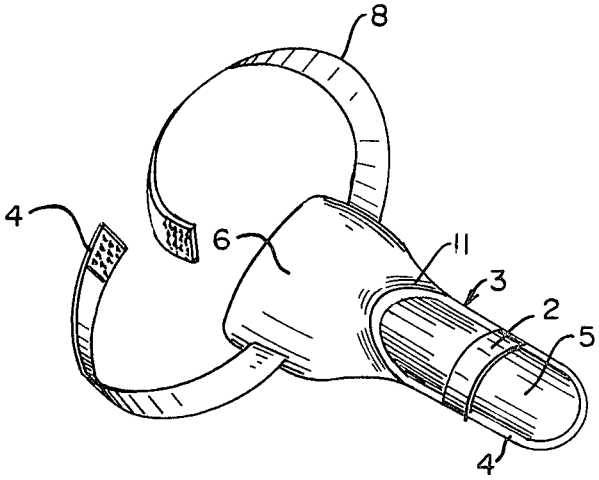
FIG. 2 provides an isometric view of the finger support of this invention.

In referring to the drawings, and in particular FIG. 1, the usual position of the bowler's hand H in association with the bowling ball B is shown, and as is well known, the two middle fingers generally insert within formed apertures provided within the ball, as shown, while the little finger F and the index finger I are extended for resting upon the surface of the ball. And, the bowler's finger support 1 of this invention, as can be seen in full in FIG. 2, disposes its band 2 around this little finger so as to maintain the support in place.

Figure 3:
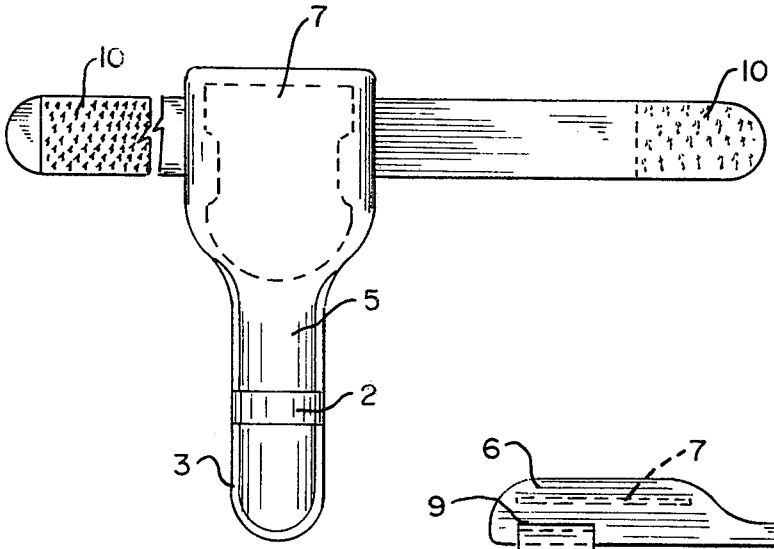
FIG. 3 furnishes a plan view of the support shown in FIG. 2.
Figure 4:
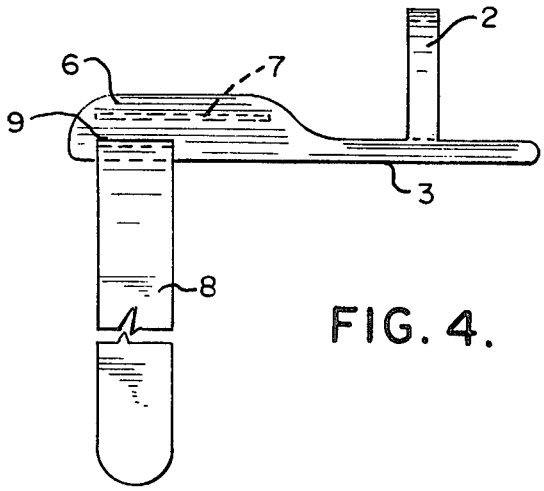
FIG. 4 provides a side view of the support of FIG. 3.

The support 1, as also seen in FIGS. 3 and 4, includes a base member 3 of some length, generally of sufficient length so as to lie longitudinally against the inner surface of the little finger and the upper region of the palm biologically associated therewith. The upper portion of the support is design cut, as at 4, for the purpose of forming a trough like part 5 that cradles the finger, and having the integral band 2, as shown, so as to provide means into which the little finger may be inserted and embraced during usage of this support. The lower portion 6 of the support yet retains around its circumference the tubular shape of the material from which it is fabricated, and for two purposes, the first being to provide a location wherein the tab 7 may be forcefully inserted, and thereby widen and substantially flatten this lower portion of the support, and at the same time, provide some thickness to the support at this location so as to furnish a displacement of the ball from the little finger and proximate the hand palm at this location thereby effectively shifting the center of gravity of the ball laterally towards the palm center for more control by the index finger of the bowler's delivery hand. Obviously, this support could also be molded as a one piece item, having the metal or other hard material spacer or tab molded therein.

As also can be seen from FIGS. 1 though 4, a strap means 8 inserts through slots 9 of this lower portion of the support, and this strap includes sufficient length to provide for its wrapping around the hand of the wearer to insure the placement and sustained positioning of the support upon the bowler's hand during usage. This strap means may include any form of fastening means 10, such as the Velcro as shown, or any other form of snap fastener, in order to insure the closure of the strap and retention of the support in place during usage. In addition, this strap means may also be fabricated from an elastic material so as to provide a sustained tightening of the support upon the bowler's hand during usage.

As can be seen from FIGS. 3 and 4, the tab means 7 is generally flat in configuration, having sides with rounded contours to allow for its ease of forceful insertion within the lower portion 6 of the support, and therein function to cause a widening or flattening of the support into the disposition as shown clearly in FIG. 3, but at the same time, insure some height or bulk in at least this lower portion, as can be seen in FIG. 4, for the purpose of providing some lift for ball displacement off of the contiguous palm portion of the bowler's hand. And, in this manner, the ball is conveniently shifted in its disposition towards the other side of the hand, or towards the controlling index finger, so that it may exert more pressure upon the ball during its release in order to enhance ball control during delivery down the alley. In addition, and in order to add to the convenience and confort of the bowler's hand during usage of this support, it may be made slightly beveled, as at 11, so as to remove any sharp edges from the support and thereby add to the comfort of its user.

Figure 5:
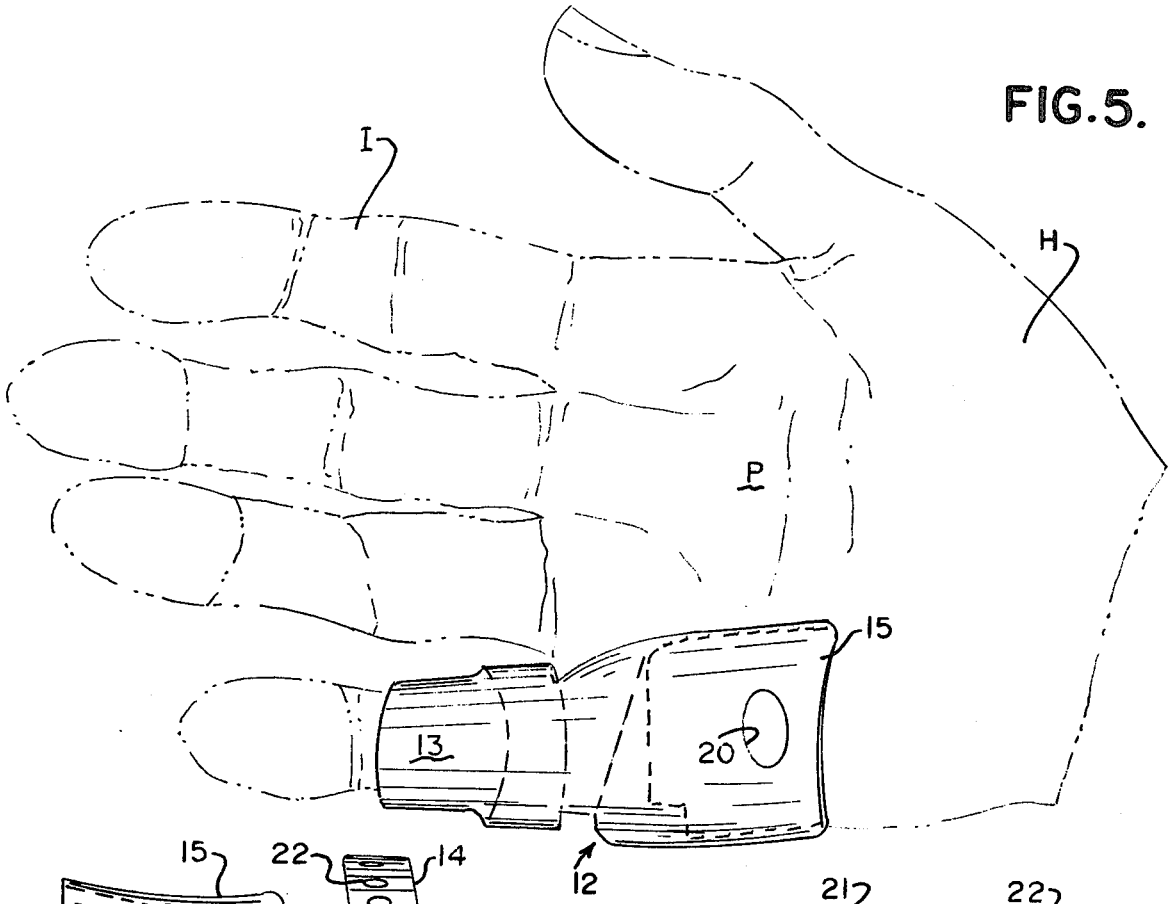
FIG. 5 shows a modified form of support properly positioned upon the little finger of the bowler's delivery hand.
Figure 6:
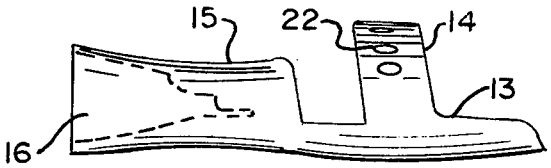
FIG. 6 furnishes a left side view of the support shown in FIG. 5.
Figure 7:
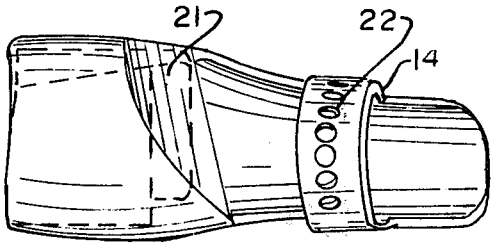
FIG. 7 provides a plan view of the support shown in FIG. 5.
Figure 8:
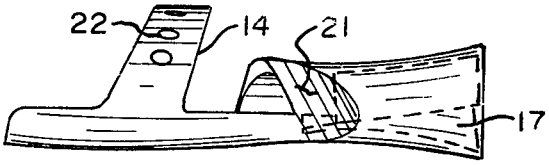
FIG. 8 provides a right side view of the support shown in FIG. 5.
Figure 9:
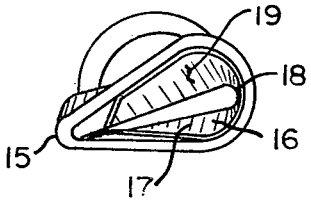
FIG. 9 furnishes a lower end view of the bowler's support.

A modification to the bowler's finger support of this invention is shown in FIGS. 5 through 10. As can be seen in FIG. 5, the support 12 is shown in application upon the little finger of the bowler's hand. And, this is a similar manner in which the support 1 is also applied to the same hand. In this construction, the support 12 is also formed having its upper portion 13 design cut to incorporate a band 14 integrally of the said upper portion, while the lower portion 15 of the support yet retains its tubular shape and has forcefully inserted therein, or molded therein, a contoured tab 16 that furnishes some slant to the configuration of this invention and therein effectively urge the ball towards the opposite side of the bowler's hand. As can be seen in FIG. 9, this tab 16 incorporates a first flange 17 and is integrally bent around a radius 18 to form an upper flange 19, which as can be seen, provides an inclined shape to the upper part of the lower portion 15, so that when the little finger of the bowler's hand is inserted therein, this lower portion acts as a wedge having its widened radius 18 positioned at the side of the hand, and with this wedging shape forcing the ball into a direction towards the opposite side, or towards the index finger, of the hand of the bowler. Usually the spacer or plate 16 will be formed of a hardened material, such as metal, and thereby conveniently withstand the weight and pressure of the bowling ball resting thereon, and not deform under its weight.

Figure 10:
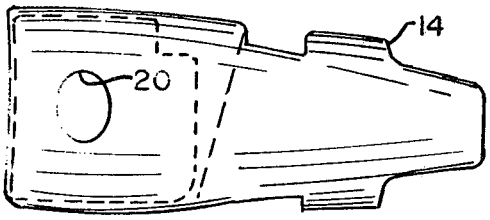
FIG. 10 provides a bottom plan view of the bowler's support, generally similar to the view of the support shown emplaced in FIG. 5.

The material, such as polymer tubular material, forming the support of this invention is generally of a flexible and soft texture, so as to not cause any scuff to the surface of the bowling ball, and conveniently and substantially seal the metal tab 16 within its lower portion. In addition, the lower portion of the support that abuts against the surface of the bowling ball during usage, and as can be seen in FIGS. 5 and 10, may have some form of a cavity or aperture 20 formed therein, and in this manner act as a convenient seat for the bowling ball resting thereon, at least at this lateral location, and thereby assure its proper positioning for constant urging of the said ball in a direction towards the opposite side of the hand, as towards the index finger I, and the palm center P. Furthermore, and to further add to the positional contour or bevel of the support, at least in the location of this upper segment of the palm connecting with the little finger, a bevel may be formed, as through skiving, at the location 21 of this portion of the support, and therein provide clearance for a further skewed positioning of this support intermediate the hand palm and the bowling ball, and thereby secure the convenient positioning of the wedging shape of this lower portion, as formed through the inclined positioning of the plate 16, for insuring the constant urging of the bowling ball towards that delivery controlling index finger of the bowler's hand. In addition, and to add to the convenience in the usage of this support, the integral band 14 may contain a series of perforations, as at 22, and therein function as a means for ventilating the finger underlying this band, and in addition, add to the stretchability of the band for the convenience of the user when applying or removing the support onto or off of the finger during usage.

Various modifications or variations in the support of this invention may occur to those skilled in the art upon reviewing the subject matter of this application. Any such variations or modifications, if within the spirit of this invention, and within the scope of the appended claims, are intended to be protected by any United States patent issuing upon the same. The description of the preferred embodiment set forth is done so for illustrative purposes only.

Having thus described the invention what is claimed and desired to be secured by Letters Patent is:

1. A finger support for application by a bowler in association with the little finger on the ball delivery hand and for use in urging the ball in a direction towards the index finger and the proximate portion of the palm of the bowler's hand, comprising, a base member extending longitudinally of the little finger of the hand when in use and for disposition contiguous with the inner surface of the said finger and the approximate region of the upper palm associated with such finger and aligned therewith, a band means connecting with the upper portion of the base member and for snugly surrounding the said little finger to insure retention of the support upon the hand, the lower portion of the base member widened and thickened for disposition intermediate the said aligned palm region and the bowling ball to effect ball displacement from the hand at this location and causing a shift of the weight towards the index finger of the ball supporting hand, said base member, band means, and lower portion all being cut and formed from a tubular type flexible material, said material being designed cut at its upper portion to form the said base member and integral band means of the support, a spacer means provided within the lower portion of the base member to provide means for maintaining the thickened and widened disposition of the support at said location, said spacer means comprising a plate that is tapered and forms an upper angular surface within the widened lower portion of the base member and useful for urging the ball further towards the center of the bowler's palm, whereby the ball is urged in the direction towards the index finger and the proximate portion of the palm of the bowler's hand.

2. The invention of claim 1 and wherein said plate is formed of metal.

3. The invention of claim 1 and wherein said plate is folded over upon itself and forms an upper angular surface within the widened lower portion of the base member and useful for urging the ball further towards the center of the bowler's palm.

4. The invention of claim 3 and wherein said lower portion being beveled at its upper edge to further effect the ball's urging towards the center of the bowler's palm.

5. The invention of claim 1 and wherein said band means includes a series of perforations therein to ventilate the little finger encompassed thereby.

6. The invention of claim 1 and including a strap means connecting with the support in the region of its lower portion and provided for fastening around the hand and for further securing the support thereto.

7. The invention of claim 1 and therebeing a cavity formed upon the lower portion of the support and useful for positioning the ball with respect to the said support.

8. The invention of claim 7 and wherein said cavity comprises an aperture formed within the lower portion of the support.

* * * * *